United States Patent [19]

Harris et al.

[11] Patent Number: 4,811,529

[45] Date of Patent: Mar. 14, 1989

[54] FIRE RESISTANT FLEXIBLE SEAL

[75] Inventors: Kendall R. Harris; Leonard C. Spriggs; Ralph J. Block, all of Houston, Tex.

[73] Assignee: B&B Progessive Material & Technologies, Inc., Houston, Tex.

[21] Appl. No.: 394,252

[22] Filed: Jul. 1, 1982

[51] Int. Cl.[4] ..... E04B 1/66; F16J 15/16

[52] U.S. Cl. ..... 52/396; 52/393; 52/573; 277/193; 277/189; 277/205; 277/227; 428/920

[58] Field of Search ..... 52/396, 395, 403, 573, 52/393; 428/920; 277/227, 205, 193, 226, 189, 229, DIG. 6

[56] References Cited

U.S. PATENT DOCUMENTS

| | | | |
|---|---|---|---|
| 1,190,857 | 7/1916 | Burgher | 428/920 X |
| 1,357,713 | 11/1920 | Lane | 52/573 X |
| 2,101,836 | 12/1937 | Benedict | 428/920 X |
| 2,173,815 | 9/1939 | Slisz et al. | 428/920 X |
| 2,312,301 | 3/1943 | Turner et al. | 428/920 X |
| 2,576,698 | 11/1951 | Russum | 428/920 X |
| 2,988,183 | 6/1961 | Hallock | 52/573 |
| 3,058,551 | 10/1962 | Martin | 52/573 |
| 3,388,516 | 6/1988 | Thielen | 52/393 |
| 3,670,470 | 6/1972 | Thom | 52/395 |
| 3,797,183 | 3/1974 | Kobayashi et al. | 52/573 X |
| 4,055,925 | 11/1977 | Wasserman et al. | 52/395 |

*Primary Examiner*—Allan N. Shoap

*Attorney, Agent, or Firm*—Hubbard, Thurman, Turner & Tucker

[57] ABSTRACT

A fire resistant flexible seal for sealing a breach between movable architectural barriers. The flexible seal is comprised of a plurlaity of layers of fire resistant materials. In a preferred embodiment, a first non-porous sheet is affixed to each side of the breach and forms an open loop within the gap. The size of the loop may be varied to accommodate the amount of movement anticipated by the architect. A blanket of ceramic insulating material is nested within the loop formed by the non-porous sheet and a second blanket is mounted in an open loop across the breach, thereby defining an enclosed air space between the ceramic insulating blankets. A second non-porous sheet is nested within the upper ceramic blanket and serves to enclose the ceramic blankets within a moisture resistant envelope. In alternate applications in which it is desired to achieve the capability to withstand high pressure, an additional sheet of high strength heat resistant material can be added to the seal.

19 Claims, 1 Drawing Sheet

FIRE RESISTANT FLEXIBLE SEAL

BACKGROUND OF THE INVENTION

This invention relates in general to seals for providing a fire resistant barrier across a breach in an architectural structure, and in particular to seals which maintain a fire resistant barrier across a breach in an architectural structure despite relative movement of each side of the architectural structure.

In recent years it has been known that a degree of security from seismic damage may be achieved by the utilization of movable architectural structures. Such structures typically include a gap or breach between adjacent structural elements (such as a wall and a floor). The breach will permit a limited amount of relative movement between the individual structural elements without resulting in permanent damage to the structure.

A problem generated by the utilization of these so-called seismic gaps is that such gaps provide a ready communication from one section of a structure to another, thus permitting a fire or flooding situation to spread rapidly throughout the structure. Known attempts to solve this problem have typically utilized a compressible insulating material, such as a plastic foam, to fill these seismic gaps. While these compressible foams will provide a high degree of static insulation in the seismic gaps, a small amount of relative movement by the architectural barrier can result in an opening through the seismic gap through which fire or flooding may spread.

SUMMARY OF THE INVENTION

Accordingly, it is an object of the present invention to provide an improved fire resistant flexible seismic gap seal.

It is another object of the present invention to provide an improved fire resistant, water resistant, air pressure and smoke barrier seismic gap seal.

It is yet another object of the present invention to provide an improved seismic gap seal which maintains a fire resistant seal despite relative movement by each side of the seismic gap.

It is another object of the present invention to provide an improved seismic gap seal which is relatively inexpensive and simple to install.

It is yet another object of the present invention to provide an improved seismic gap seal which includes an enclosed insulated air space.

The foregoing objects are achieved as is now described. The flexible seal is comprised of a plurality of layers of fire resistant materials. In a preferred embodiment, a first non-porous sheet is affixed to each side of the breach and forms an open loop within the gap. The size of the loop may be varied to accommodate the amount of movement anticipated by the architect. A blanket of ceramic insulating material is nested within the loop formed by the non-porous sheet and a second blanket is mounted in an open loop across the breach, thereby defining an enclosed air space between the ceramic insulating blankets. A second non-porous sheet is nested within the upper ceramic blanket and serves to enclose the ceramic blankets within a moisture resistant envelope. In alternate applications in which it is desired to achieve the capability to withstand high pressure, an additional sheet of high strength heat resistant material can be added to the seal.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
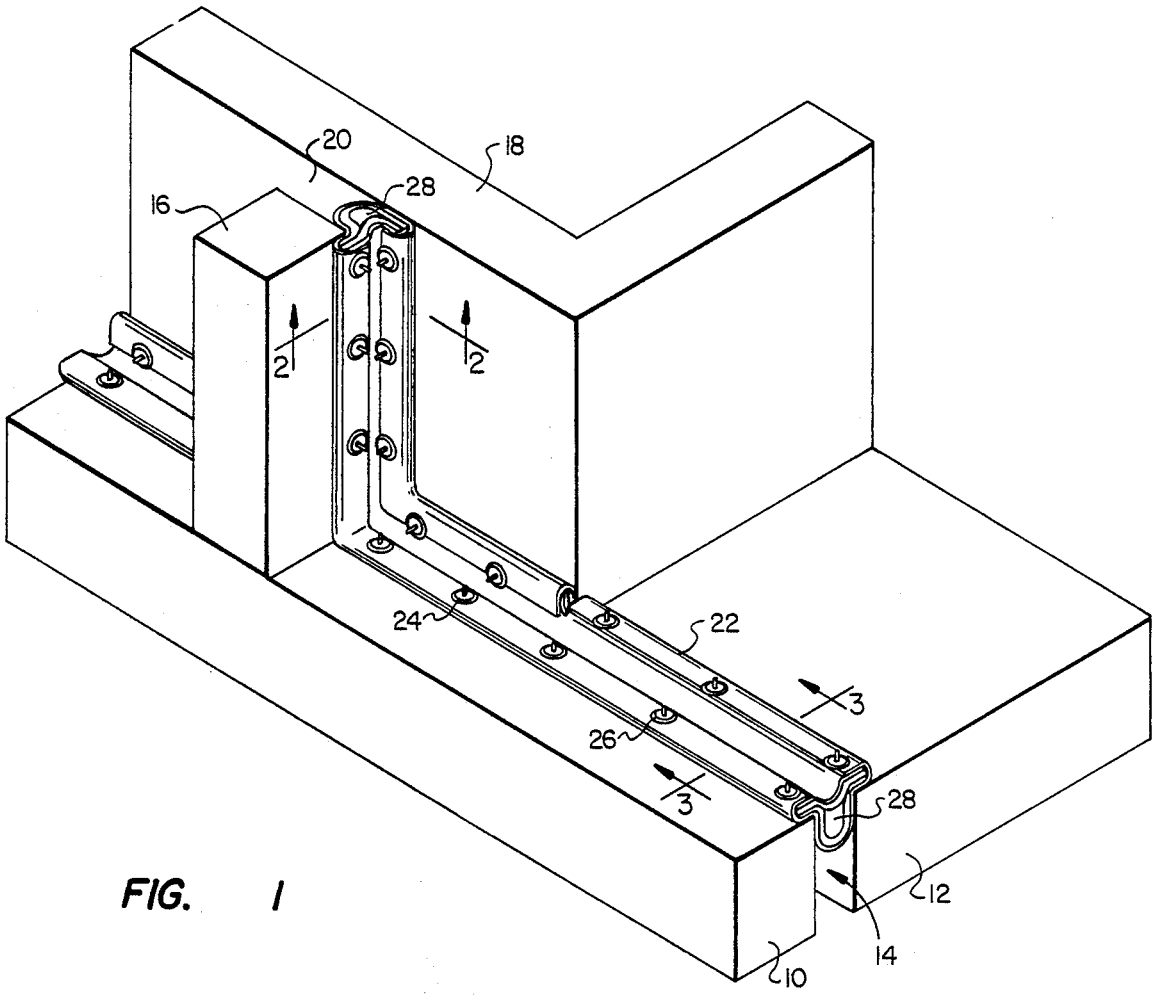
FIG. 1 is a perspective view of a movable architectural barrier and the novel flexible seismic gap seal of the present invention.

With reference now to the figures and in particular to FIG. 1, there is depicted a perspective view of a movable architectural barrier which incorporates the flexible seal of the present invention. The movable architectural barrier is comprised of a first floor section 10 and a second floor section 12 which define a seismic gap 14. Additionally, floor sections 10 and 12 may support wall sections 16 and 18 which further define a vertical seismic gap 20.

Seismic gaps 14 and 20 are both sealed by means of flexible seal 22, which is held in place by a plurality of mounting pins such as those denoted by reference numerals 24 and 26. Flexible seal 22 is a multiple layer seal which encompasses enclosed air space 28. The composition and number of the various layers of flexible seal 22 are discussed in detail below.

Figure 2:
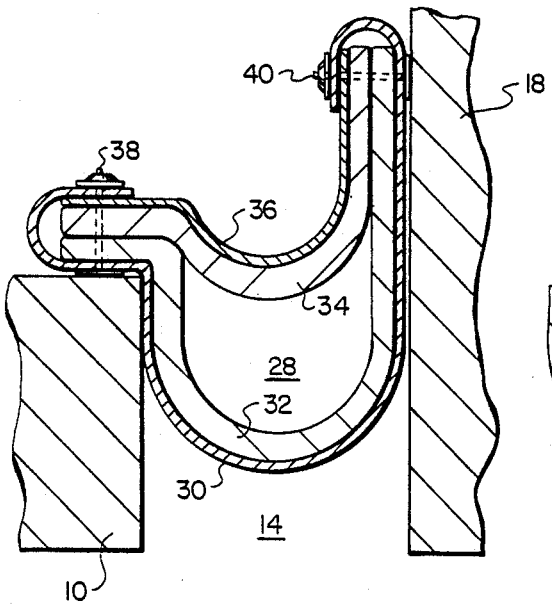
FIG. 2 is a sectional view of the novel seismic gap seal of the present invention in a configuration utilized to seal a breach between a floor section and a wall section.

With reference now to FIG. 2, there is depicted a sectional view of the flexible seal of the present invention which is suited to seal a breach between floor section 10 and wall section 18. The embodiment disclosed in FIG. 2 comprises four layers of fire retardant and/or insulating material; however, additional layers may be utlized and as few as two layers may be utilized to accomplish the advantages of the present invention.

The lowermost layer 30 of flexible seal 22, as depicted in FIG. 2, is a relatively thin, non-porous sheet of high silica content fiberglass mat. In a preferred embodiment, layer 30 is an aluminized mat such as that manufactured under the trade name Siltemp, by Ametek, Inc. of Wilmington, Del. Layer 30 is preferably approximately 0.030 inches in thickness and provides a pliable, non-porous water resistant cover for the interior layers. Layer 30 is affixed to either side of the seismic gap and is formed into an open loop within gap 14. The amount of material utilized to form the open loop in layer 30 is entirely dependent upon the amount of movement anticipated between floor 10 and wall 18.

In the disclosed embodiment of flexible seal 22, two interior layers 32 and 34 of insulating material are utilized to define an enclosed air space 28. Layers 32 and 34 are each comprised of approximately a one inch thickness of a ceramic blanket insulating material. Such ceramic blankets are typically constructed of alumina or silica fibers and provide a high degree of thermal insulation when dry. Hence, the utilization of non-porous layer 30 to provide a moisture resistant barrier around layers 32 and 34. Layer 32 is nested within layer 30 and layer 34 is affixed to either side of seismic gap 14 and defines a second open loop, the length of which is again entirely dependent upon the anticipated amount of movement by floor 10 and wall 18.

A second non-porous high silica content fiberglass mat forms layer 36 which is nested within the loop formed by layer 34. As depicted in FIG. 2, the ends of layer 30 are wrapped around the exposed ends of layers 32, 34 and 36 and then fastened through these layers, thus forming a relatively moistureproof envelope for the interior layers. To enhance the moisture proof characteristics of this seal, silicone adhesive sealants may be used to complete the envelope.

Flexible seal 22 may be mounted to floor section 10 and wall section 18 in a variety of manners. In the depicted embodiment, mounting pins are fixed to wall section 18 and floor section 10 by means of any well known adhesive and the various layers of flexible seal 22 are then pressed onto pins 38 and 40 and then slipped into place. In alternate embodiments, flexible seal 22 may be affixed to either side of seismic gap 14 by means of any commercially available concrete anchor or any other well known mounting technique. Additionally, an elongated metal strip may be utilized to anchor flexible seal 22 in conjunction with such commercially available concrete anchors.

Figure 3:
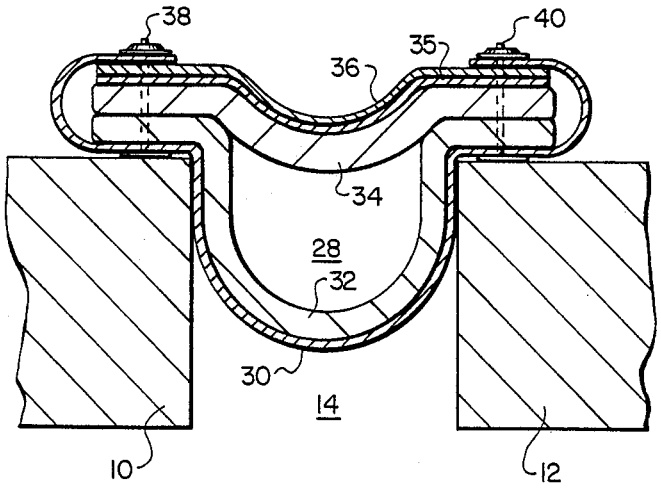
FIG. 3 is a sectional view of the novel seismic gap seal of the present invention in a configuration utilized to seal the breach between two floor sections.

With reference now to FIG. 3, there is depicted a sectional view of an embodiment of the flexible seal of the present invention which is suited to seal a breach between two floor sections, 10 and 12. As in FIG. 2, the primary structural advantage of flexible seal 22 can be seen to be the ability of flexible seal 22 to expand and contract with relative movement of floor sections 10 and 12, while maintaining a fire resistant barrier and an enclosed insulating air space 28. In addition to the multiple layers discussed with reference to FIG. 2, the seal depicted in FIG. 3 also includes an additional layer 35 for providing a high pressure resistant seal which can withstand higher pressure requirements than those normally utilized in the ASTM E-119 time/temperature test (including the applicable hose stream test) for installation in a three hour rated fire wall. Additional layer 35 may be constructed of an additional layer of the material utilized to construct layers 30 and 36, or an alternate material having higher tensile strength, as desired.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A fire resistant flexible seal for sealing a breach between movable architectural barriers, said seal comprising:

a first flexible blanket of insulating material affixed to each side of said breach and defining a first open loop therebetween; and a second flexible blanket of insulating material affixed to each side of said breach and defining a second open loop therebetween, wherein an enclosed air space is defined between said first blanket of insulating material and said second blanket of insulating material.

2. The fire resistant flexible seal according to claim 1 wherein said insulating material is comprised of ceramic insulating fibers and fire resistant fabric.

3. The fire resistant flexible seal according to claim 1 further including a plurality of pins anchored to each side of said breach whereby said first and second blankets are affixed to each said of said breach by said pins.

4. The fire resistant flexible seal according to claim 3 wherein said plurality of pins are anchored to each side of said breach by means of an adhesive material.

5. The fire resistant flexible seal according to claim 1 wherein said first and second flexible blankets of insulating material are affixed to each side of said breach by means of concrete anchors.

6. A fire resistant flexible seal for sealing a breach between movable architectural barriers, said seal comprising:

a first flexible sheet of non-porous heat resistant material affixed to each side of said breach and defining a first open loop therebetween;

a first flexible blanket of insulating material affixed to each side of said breach and nested within said first open loop;

a second flexible blanket of insulating material affixed to each side of said breach and defining a second open loop therebetween wherein an enclosed air space is defined between said first blanket of insulating material and said second blanket of insulating material; and, a second flexible sheet of non-porous heat resistant material affixed to each side of said breach and nested within said second open loop.

7. The fire resistant flexible seal according to claim 6 wherein each of said flexible sheets of non-porous heat resistant material comprises a relatively thin sheet of high silica content fiberglass mat.

8. The fire resistant flexible seal according to claim 6 wherein said insulating material is comprised of ceramic insulating fibers.

9. The fire resistant flexible seal according to claim 6 further including a plurality of pins anchored to each side of said breach whereby said first and second sheet flexible and first and second flexible blanket are affixed to each side of said breach by said pins.

10. The fire resistant flexible seal according to claim 9 wherein said plurality of pins are anchored to each side of said breach by means of an adhesive material.

11. The fire resistant flexible seal according to claim 6 wherein said first and second flexible sheets and said first and second flexible blankets are affixed to each side of said breach by means of concrete anchors.

12. The fire resistant flexible seal according to claim 6 wherein opposing edges of said first flexible sheet of non-porous heat resistant material are folded over the edges of said first and second flexible blanket and said second flexible sheet and anchored to each side of said breach through said first and second flexible blanket and said second flexible sheet.

13. A fire resistant flexible seal for sealing a breach between movable architectural barriers, said seal comprising:

a first flexible sheet of non-porous heat resistant material affixed to each side of said breach and defining a first open loop therebetween;

a first flexible blanket of insulating material affixed to each side of said breach and nested within said first open loop;

a second flexible blanket of insulating material affixed to each side of said breach in defining a second open loop therebetween wherein an enclosed air space is defined between said first flexible blanket of insulating material and said second flexible blanket of insulating material;

a flexible sheet of relatively high strength pressure resistant material anchored to each side of said breach and nested within said second open loop; and a second flexible sheet of non-porous heat resistant material anchored to each side of said breach and nested within the open loop formed by said flexible sheet of relatively high strength pressure resistant material.

14. The fire resistant flexible seal according to claim 13 wherein each of said flexible sheets of non-porous heat resistant material comprises a relatively thin sheet of high silica content fiberglass mat.

15. The fire resistant flexible seal according to claim 13 wherein said insulating material is comprised of ceramic insulating fibers.

16. The fire resistant flexible seal according to claim 13 further including a plurality of pins anchored to each side of said breach whereby said first and second flexible sheet of non-porous heat resistant material, said first and second flexible blanket of insulating material and said flexible sheet of relatively high strength pressure resistant material are affixed to each side of said breach by said pins.

17. The fire resistant flexible seal according to claim 16 wherein said plurality of pins are anchored to each side of said breach by means of an adhesive material.

18. The fire resistant flexible seal according to claim 13 wherein said first and second flexible sheets of non-porous heat resistant material, said first and second flexible blankets of insulating material and said flexible sheet of relatively high strength pressure resistant material are affixed to each side of said breach by means of concrete anchors.

19. The fire resistant flexible seal according to claim 13 wherein opposing edges of said first flexible sheet of non-porous heat resistant material are folded over the edges of said first and second flexible blanket of insulating material, said flexible sheet of relatively high strength pressure resistant material and said second flexible sheet of non-porous heat resistant material and anchored to each side of said breach through said first and second flexible blanket of insulating material, said flexible sheet of relatively high strength pressure resistant material and said second flexible sheet of non-porous heat resistant material.

* * * * *

UNITED STATES PATENT AND TRADEMARK OFFICE

CERTIFICATE OF CORRECTION

PATENT NO. : 4,811,529

DATED : March 14, 1989

INVENTOR(S) : Kendall R. Harris, Leonard C. Spriggs and Ralph J. Block

It is certified that error appears in the above-identified patent and that said Letters Patent is hereby corrected as shown below:

Col. 4, line 9, "said of said breach" should be --side of said breach--.

Col. 4, lines 45 and 46, "whereby said first and second sheet flexible and first and second flexible blanket" should be --whereby said first and second flexible sheet and said first and second flexible blanket--.

Signed and Sealed this

Third Day of October, 1989

*Attest:*

*Attesting Officer*

DONALD J. QUIGG

*Commissioner of Patents and Trademarks*